US008309894B2

(12) United States Patent
Zimmer et al.

(10) Patent No.: US 8,309,894 B2
(45) Date of Patent: Nov. 13, 2012

(54) TRIAC CONTROL OF POSITIVE TEMPERATURE COEFFICIENT (PTC) HEATERS IN ROOM AIR CONDITIONERS

(75) Inventors: Tom C. Zimmer, Louisville, KY (US); Tim N. Johnson, Louisville, KY (US); Robert Lafleur, Louisville, KY (US); Brice Alan Bowley, Louisville, KY (US); Shinichi Hirose, Yao (JP); Masanobu Amazutsumi, Yao (JP); Gregory Michael Thomas, Louisville, KY (US); Tohru Ariga, Yao (JP)

(73) Assignee: General Electric Company, Schenectady, NY (US)

( * ) Notice: Subject to any disclaimer, the term of this patent is extended or adjusted under 35 U.S.C. 154(b) by 387 days.

(21) Appl. No.: 12/704,816

(22) Filed: Feb. 12, 2010

(65) Prior Publication Data

US 2011/0198340 A1 Aug. 18, 2011

(51) Int. Cl.
*H05B 3/10* (2006.01)

(52) U.S. Cl. ..... 219/552

(58) Field of Classification Search ..... 219/494, 219/492, 490, 552; 62/3.2, 3.3, 351, 228.4; 392/360–361
See application file for complete search history.

(56) References Cited

U.S. PATENT DOCUMENTS

| | | | | |
|---|---|---|---|---|
| 4,285,210 | A | 8/1981 | McCarty | |
| 4,346,755 | A | 8/1982 | Alley et al. | |
| 4,439,995 | A | 4/1984 | McCarty | |
| 4,534,179 | A | 8/1985 | Stocking et al. | |
| 5,491,323 | A * | 2/1996 | Mori et al. | 219/710 |
| 5,592,647 | A | 1/1997 | Yamauchi et al. | |
| 5,673,568 | A * | 10/1997 | Isshiki | 62/228.4 |
| 7,504,606 | B2 * | 3/2009 | Hamburger et al. | 219/543 |
| 2008/0124060 | A1 | 5/2008 | Gao | |

* cited by examiner

*Primary Examiner* — David Lam
(74) *Attorney, Agent, or Firm* — Fay Sharpe LLP

(57) ABSTRACT

An electric heating module for a room air conditioning system and methods are presented in which the duty cycle of the electric heater banks are controlled to limit the inrush current during the startup phase of the heater or to supplement the heat generated by the heat pump when the heat capacity of the heat pump nears the heat loss of the room being heated.

20 Claims, 6 Drawing Sheets

TRIAC CONTROL OF POSITIVE TEMPERATURE COEFFICIENT (PTC) HEATERS IN ROOM AIR CONDITIONERS

BACKGROUND OF THE DISCLOSURE

Room air conditioning units are employed to provide temperature control of a room. When transferring heat from outdoors into the room, the efficiency of a heat pump can be measured by the coefficient of performance (COP), which is found by dividing the outdoor heat supplied by the heat pump to the room by the amount of energy used to supply that heat. Both the heating capacity and the COP of a heat pump are reduced as the outdoor temperature drops. The outdoor temperature at which the heat capacity of the heat pump is equal to the heat loss of the room is called the "balance point." When the outdoor temperature is less than balance point, supplemental heaters are needed to generate the heat required to reach the desired room temperature.

Some supplemental heating approaches burn natural gas or petroleum-based fuels to generate supplemental heat, but some areas do not have easy access to natural gas or petroleum-based fuels, or it is dangerous to store the highly combustible natural gas or fuels. Another supplemental heating approach uses an electric wire with a predetermined resistance to generate heat, but this approach results in units that require costly heat shields and safety concerns. Yet another approach uses positive temperature coefficient (PTC) heating elements to generate heat, but the heat output of the PTC heating elements degrade over time and may fail before other elements in the unit. This approach also runs the PTC heaters at maximum capacity whenever supplemental heat is required, regardless of how much supplemental heat is required. When more supplemental heat is generated than is required, the room heats quickly and the amount of time the supplemental heater is activated is relatively short. The room cools down while the electric heat is not activated and the electric heat module will need to be activated again. The relatively frequent cycling associated with such an arrangement may lower the life span of the PTC heaters. Thus, there is a continuing need for improved electric heating modules for room heating and air conditioning units.

SUMMARY OF THE DISCLOSURE

The present disclosure provides an electric heating module apparatus and control techniques that may be employed to facilitate regulation of an AC power signal supplied to an electric heater bank to limit the inrush current when the electric heater bank is in a startup phase, to regulate the heat generated by the electric heater bank when the electric heater bank and heat pump are in a crossover mode, to reduce frequency of the ON/OFF cycling of the heater bank or both.

An electric heating module for a room air conditioning system is disclosed, which includes a fan that generates an airflow across an electric heater bank. A heating module controller is provided which drives a switch to selectively pass or block current flow from an AC input to the electric heater bank. The electric heating module can thus be used to generate different levels of heat to supplement the heat produced by a heat pump. In some embodiments, the electric heater bank is a PTC heater bank.

In certain embodiments, the switch controls the duty cycle of the AC power supplied to the PTC heater bank from an external AC power source while the PTC bank is in a startup phase. In certain embodiments, the switch controls the duty cycle of the AC power supplied to the PTC heater bank from the external AC power source to regulate the amount of heat generated by the PTC bank during a crossover mode. In certain embodiments, the speed of the electric heater fan is ramped up during the startup phase of the PTC bank. In certain embodiments, the electric heating module includes a current limit module which determines the maximum current able to be drawn by the entire system. With this current limit, a bank select control will selectively activate one or more PTC heater banks. In certain embodiments, the switch is a triac.

A method is provided for operating a room air conditioner, which includes controlling a duty cycle of an AC powered electric heater to limit an inrush current and thus the heating element surface temperature, during a startup phase of the electric heater. In certain embodiments, the electric heater is a PTC heater. Certain embodiments include gradually increasing the speed of an indoor fan during the startup phase of the electric heater.

A method is provided for operating a room air conditioner, which includes operating an air conditioning portion of the system as a heat pump to heat an inside area with a PTC electric heating module of the system off in a first mode when the current outside temperature value or signal is above an upper threshold, and operating the air conditioning portion of the system as a heat pump and operating the PTC electric heating module of the system by controlling a duty cycle of AC power provided to at least one PTC heater bank of the PTC electric heating module to supplement the heat generated by the heat pump in a second mode when the current outside temperature value or signal is less than or equal to the upper threshold and greater than a lower threshold, and operating the PTC electric heating module with the heat pump off in a third mode when the current outside temperature value or signal is less than or equal to the lower threshold.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
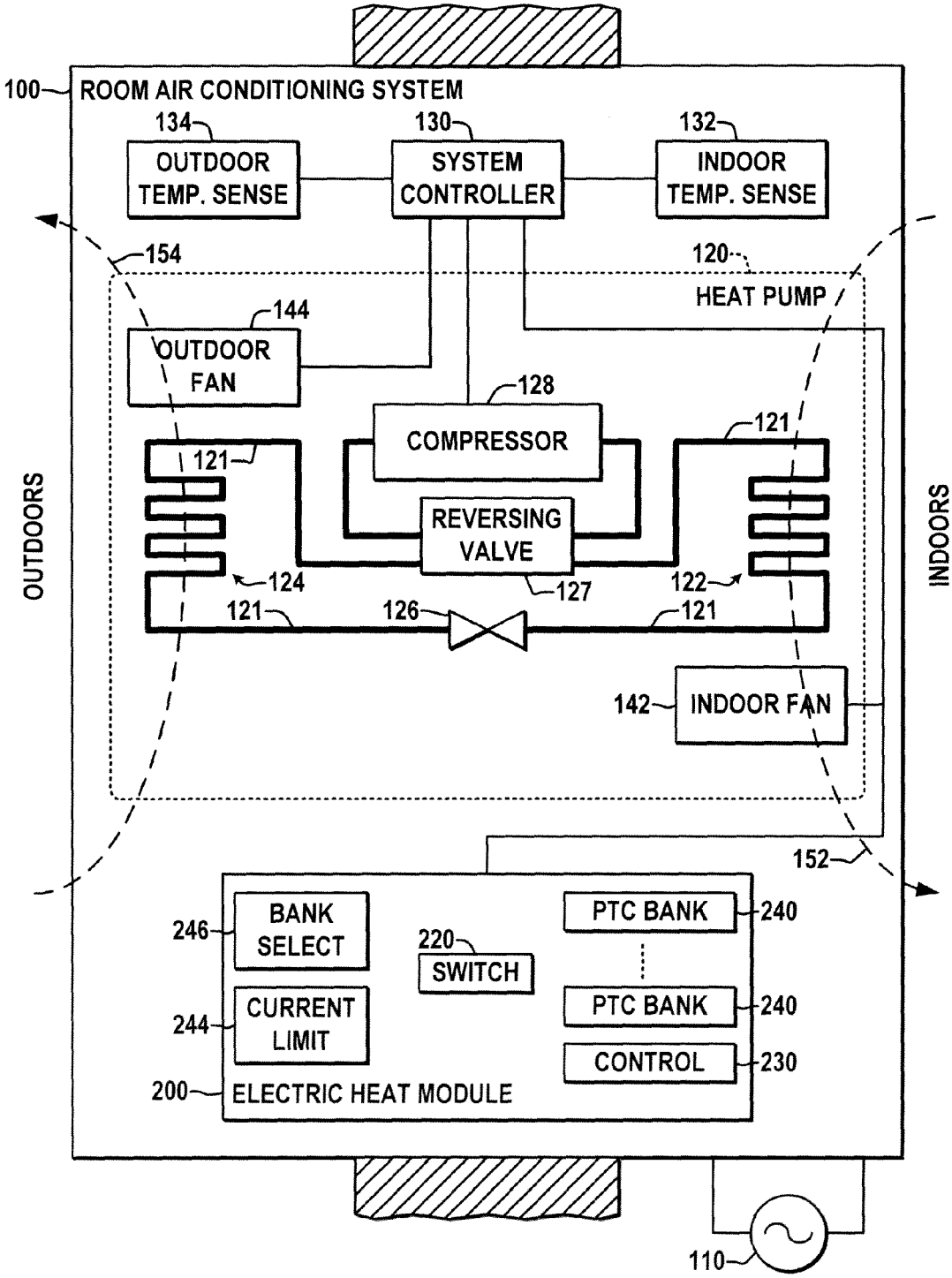
FIG. 1 is a schematic diagram illustrating an exemplary room air conditioning system including a heat pump having a compressor, an expansion valve, an indoor coil, an outdoor coil, an indoor fan, and an outdoor fan, a system controller, an indoor temperature sensor, an outdoor temperature sensor, and an electric heat module having at least one PTC heater bank.

Referring now to the drawings, where like reference numerals are used to refer to like elements throughout, and wherein the various features are not necessarily drawn to scale, the present disclosure relates to room temperature control and more particularly to electric heaters for use in connection with air conditioners. Although the disclosure is particularly advantageous in connection with PTC heating elements, and the exemplary heating modules described herein utilize PTC heating elements to generate heat, other types of electric heating elements may be used. FIG. 1 illustrates an exemplary room air conditioning system 100 in which a switch 220 (FIG. 2) selectively allows or blocks current from an external AC power source 110 to a PTC heater bank 240 of an electric heating module 200 to limit the inrush current to the system 100 during a startup phase of the electric heating module 200 and to regulate the amount heat generated by the electric heating module 200. The current example uses PTC heating elements in the supplemental heating module, but, as mentioned above, any electric heating element may be used in the supplemental heating module.

The room air conditioning system 100 includes a heat pump 120 having an indoor coil 122, an outdoor coil 124, an expansion valve 126, a reversing valve 127, a compressor 128, an indoor fan 142, and an outdoor fan 144. The compressor 128, indoor coil 122, expansion valve 126, reversing valve 127 and outdoor coil 124 are connected as shown in FIG. 1, by a tube 121 containing a refrigerant, such as Freon® or Puron® (R-410A), to form a loop. The desired operating mode of the heat pump determines the direction in which the refrigerant flows through the system. In cooling mode, the reversing valve 127 is set to cause the refrigerant to flow through the tube counterclockwise. In this mode, high pressure vapor from the compressor 128 passes through the reversing valve 127 to the outdoor coil 124. Outdoor fan 144 circulates outdoor air over the coil 124 removing heat from the refrigerant vapor which condenses to a high pressure liquid. This liquid passes through the expansion valve 126. Passage through this valve 126 lowers the temperature and pressure of the refrigerant which then enters the indoor coil 122. The indoor fan 142 pulls the inside air 152 over the indoor coils 122 and the heat of this air causes the refrigerant in the indoor coil 122 to vaporize absorbing the heat from the air 152, which cools the room. The refrigerant in vapor state then returns via the reversing valve 127 to the evaporator.

In the heating mode the reversing valve 127 is switched to reverse the direction of refrigerant flow. As in the cooling mode, the compressor 128 delivers high pressure, high temperature refrigerant vapor to the reversing valve 127, which in this mode directs the hot vapor to the indoor coil 122. The indoor fan 142 circulates the indoor air 152 over the indoor coils 122 removing heat from the hot vapor which warms the air to heat the indoor air. Removal of heat from the refrigerant condenses the vapor to a high pressure liquid which flows through the expansion valve 126 reducing the pressure and temperature of the liquid which passes to the outdoor coil 124 where it absorbs the heat from the outdoor air 154 circulated over the outdoor coil 124 by the outdoor fan 144 and expands to a hot vapor which returns to the compressor 128 via the reversing valve 127.

In certain embodiments, the flow of the refrigerant is always the same direction, but the air sources 152 and 154 across the coils 122 and 124 are switched. In such an arrangement, if refrigerant flow is always in the clockwise direction, there would be no reversing valve 127 and the coils 122 and 124 would be the condenser coil and the evaporator coil respectively. If the refrigerant always flows in the counterclockwise direction, the outdoor coil 124 would be the condenser coil and the indoor coil 122 the evaporator coil. In such a configuration, the cooling mode is the same as above. In heating mode, the refrigerant flow is the same as the cooling process, but the air sources 152 and 154 across the coils are reversed, that is, in the heating mode, the air ducting arrangement would be switched such that indoor air would be circulated over condenser coil 124 and outdoor air would be circulated over evaporator coil 122.

The flow of refrigerant or air is determined by a system controller 130. In the exemplary embodiment, an indoor temperature sensor 132 such as, but not limited to a thermocouple, a resistance temperature sensor, a thermistor, and/or a temperature-transducer integrated circuit, senses the room temperature and transmits a temperature value to the system controller 130. The system controller 130 will determine how to run the system 100 depending on a desired temperature set by the user. The system controller 130 may be implemented by any suitable form of hardware, software, firmware, programmable logic, or combination thereof, and may be a unitary control component or may be implemented in a distributed fashion.

With continued reference to the exemplary system of FIG. 1, when the outdoor temperature sensor 134 such as, but not limited to a thermocouple, a resistance temperature sensor, a thermistor, and/or a temperature-transducer integrated circuit, senses that the outdoor temperature is below the balance point 530 (FIG. 5), it sends a signal to the system controller 130. The system controller 130 activates the electric heating module 200 to generate supplemental heat to aid in heating the room. Methods of determining the balance point are discussed below in relation to FIG. 5. Further methods of operating the electric heating module 200 are discussed below in relation to FIGS. 5-6.

Still referencing FIG. 1, an external AC power source 110 supplies AC power to the system 100. Certain embodiments are provided with three PTC heater banks 240 for operation in low, medium or high power modes to allow the same unit to be installed for operation as a 2500 watt heater, 3500 watt or a 5000 watt heater. Current limit module 244 identifies the maximum current to be drawn by the air conditioning system or the maximum power rating for the air conditioning system and provides an identification signal to the bank select module 246. The bank select module 246 then determines whether one or more of the three PTC heater banks 240 will be used when supplemental heat is required. In certain embodiments, the current limit module 244 is the power cord which couples the air conditioning system 100 to the AC power supply. Three cords are available one for low, one for medium and one for high power installations, each having a unique connection configuration which when connected to the system 100, enables the controller to identify the cord and select the bank or combination of banks to conform to the power requirements or limits signified by the cord. Embodiments are not limited to the static current limit module 244 and bank select control 246 explained above; other static or dynamic methods of limiting current consumption by the system 100 may be employed.

Figure 2:
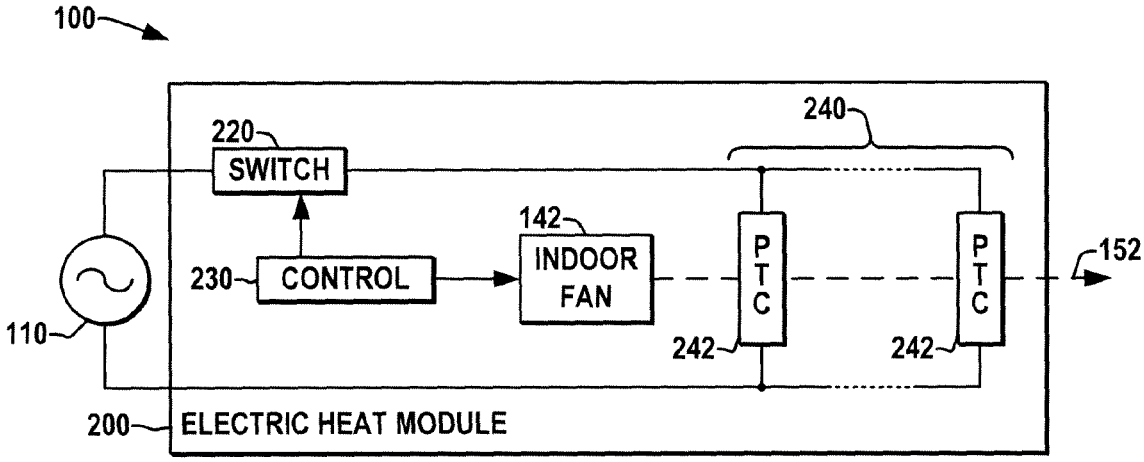
FIG. 2 is a schematic diagram illustrating an exemplary electric heating module having a PTC heater bank with one or more PTC heaters, a fan to generate airflow across the PTC heaters, a switch to control the duty cycle of the AC power supplied to the PTC heater bank, and a heating module controller in the system of FIG. 1.

FIG. 2 illustrates one suitable embodiment of an electric heating module 200 that may be used in a room air conditioning system 100, including at least one PTC heater bank 240 which includes at least one PTC heater 242. While the electric heating module 200 is activated, a heating module controller 230 generates a switch gate drive signal 232 to drive a switch 200 which selectively allows current from the external AC power source 110 to flow to the PTC heater bank 240. When the electric heating module 200 is transitioned from an inactive state to an active state, the PTC heaters 242 will undergo a startup phase. In certain embodiments, the switch 220 will modify the duty cycle of the current supplied by the external AC power source 110 to the PTC heater bank 240 during the startup phase of the PTC heaters 242. This duty cycle control limits the inrush current to the PTC heaters 242, and it is believed that limiting the inrush current to the PTC heaters 242 during startup may increase the life span of the PTC heaters 242, reduce the heat output degradation of the PTC heaters 242, or both.

In certain embodiments, the heating module controller 230 also generates a fan control signal 233 which drives a fan 142 to generate airflow across the PTC heater bank 240. In certain embodiments, while in the startup phase the fan control signal 233 generated by the heater module controller 230 gradually increases the fan speed. By utilizing a slower fan speed during the startup phase, the PTC heaters 242 achieve the desired generated heat level quicker, allowing them to exit the startup phase earlier. In certain embodiments, the fan which generates airflow across the PTC heater bank 240 is the indoor fan 142.

Figure 3:
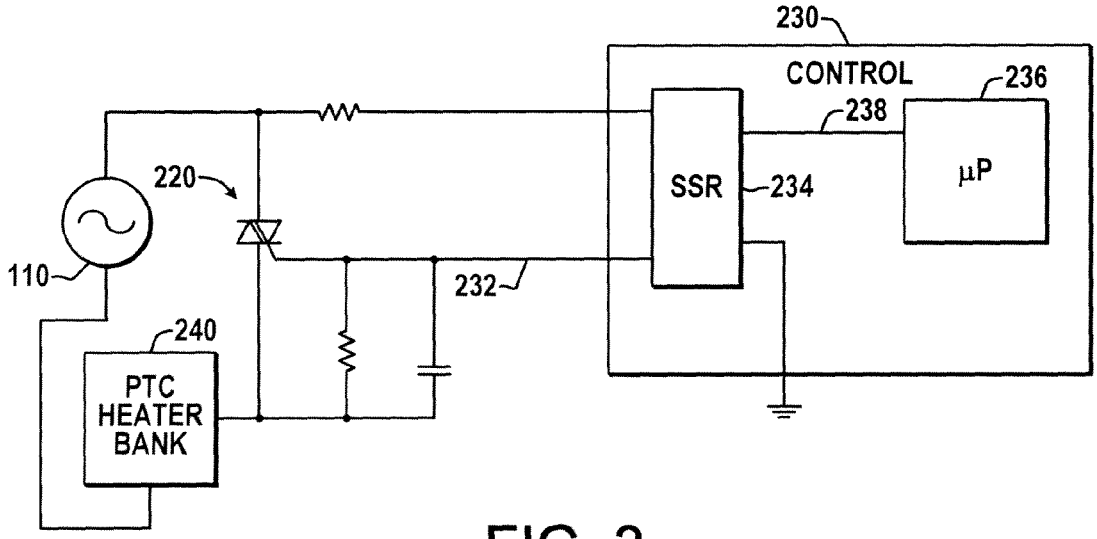
FIG. 3 is a schematic diagram illustrating an exemplary switch and heating module controller in the electric heating module of FIGS. 1-2.

FIG. 3 illustrates one suitable embodiment of the switch 220 and heating module controller 230 that may be used in the exemplary room air conditioning system 100. In this embodiment, the heating module control 230 is comprised of a microprocessor 236 which generates a relay drive signal 238 to drive the control line of a solid state relay (SSR) 234. The SSR 234 isolates the microprocessor 236 from the AC power. When the relay drive signal 238 is active, the AC power signal is received by the SSR 234 and used to generate the switch gate drive signal 232. The switch gate drive signal 232 drives the gate of the switch 220, a triac in this embodiment, which activates the triac 220 and allows the AC current to flow through to the PTC heater bank 240. The heating module controller 230 may be implemented by any suitable form of hardware, processor-executed software or firmware, programmable logic, or combination thereof, and may be a unitary control component or may be implemented in a distributed fashion. Portions of the heating module controller 230 may be components of the system controller 130, and the controllers 130 and 230 may, but need not be separate from each other.

The switch 220 may be implemented by any suitable means of hardware including, as stated above, but not limited to, a TRIAC, relay, or other semiconductor-based or electro-magnetic type switching devices, or any combination thereof. Different switches 220 may require different control means. With use of a TRIAC as the switch 220, some means of synchronizing the phase of the AC power signal to the gate signal generated by the heating module controller may be employed, such as but not limited to, a zero crossing detector to detect each half-cycle of the AC power signal.

Figure 4:
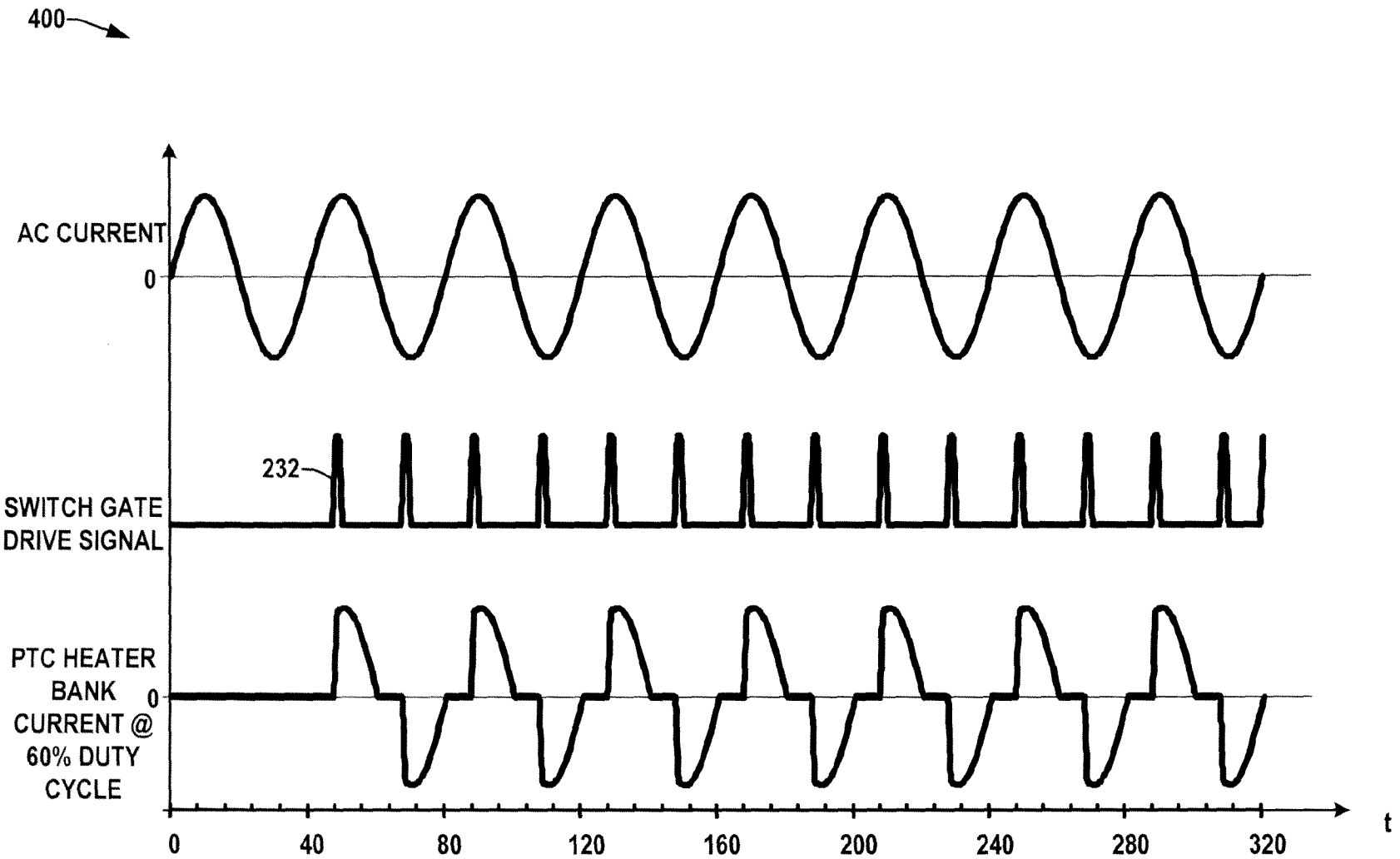
FIG. 4 is a graph illustrating exemplary waveforms of switch control signal and the resulting current through the PTC heater bank during a crossover mode of the exemplary system of FIGS. 1-3.

FIG. 4 is a composite graph 400 further illustrating operation of the exemplary TRIAC switch 220 and heating module controller 230 of FIG. 3. The horizontal axes of the graphs represent time, and one cycle of the external AC power source 110 is represented by 40 units on the horizontal axis. In this example, the external AC power source 110 supplies a 60 Hz signal, therefore each unit of time represents $1/2400$ sec. The top graph is a waveform of the current supplied by the external AC power source 110. The middle graph is the switch gate drive signal 232 generated by the heating module controller 230. The bottom graph is a waveform representing the current passed from the external AC power source 110 to the PTC heater bank 240.

Starting at t0, the TRIAC switch 220 is blocking all of the current supplied by the external AC power source 110 from reaching the PTC heater banks 240. Sometime between time unit 28 and time unit 40, the electric heating module 200 is activated and the system controller 130 determines that a 60% duty cycle is required to generate the proper amount of supplemental heat to heat the room. A method 600 the system controller 130 may use to determine the desired duty cycle is described below in reference to FIGS. 5-6. At the beginning of the next cycle at unit 40, the switch continues blocking the current until unit 48 when the heating module controller 230 pulses the switch gate drive signal 232. When the switch gate drive signal 232 activates the gate of the TRIAC switch 220, the current is allowed to pass from the external AC power source 110 to the PTC heater bank 240. By time unit 49, the switch gate drive signal 232 is not activated, but the current through the TRIAC switch 220 is greater than the holding current requirement of the TRIAC, so current continues to flow through the TRIAC switch 220 to the PTC heater bank 240. At time unit 60 when the current through the TRIAC switch 220 reaches zero, there is not enough current to hold the TRIAC 220 in the conducting state so the TRIAC switch 220 ceases to allow current to pass to the PTC heater bank 240. For the positive half-cycle of the AC power during time units 40-60, the current was allowed to pass for 12 time units and is blocked for 8 time units, which is a 60% duty cycle for that half-cycle (12/20=0.6).

The negative half-cycle of the AC power starts at time unit 60. From time unit 60-68, no current is passed to the PTC heater bank 240 because the TRIAC switch 220 was deactivated at unit 60. At unit 68, the heating module controller 230 pulses the switch gate drive signal 232. When the switch gate drive signal 232 activates the gate of the TRIAC switch 220, the current is allowed to pass from the external AC power source 110 to the PTC heater bank 240. By time unit 69, the switch gate drive signal 232 is deactivated, but the current through the TRIAC switch 220 is greater than the holding current requirement of the TRIAC, so current continues to flow through the TRIAC switch 220 to the PTC heater bank 240. At time unit 80 when the current through the TRIAC switch 220 reaches zero, the current is not enough to hold the TRIAC in the conducting state so the TRIAC switch 220 stops allowing current to pass to the PTC heater bank 240. For negative half-cycle time units 60-80, the current was allowed to pass for 12 time units, which is a 60% duty cycle for that half-cycle. Combining the positive and negative half-cycles results in a full cycle with a 60% duty cycle.

Figure 5:
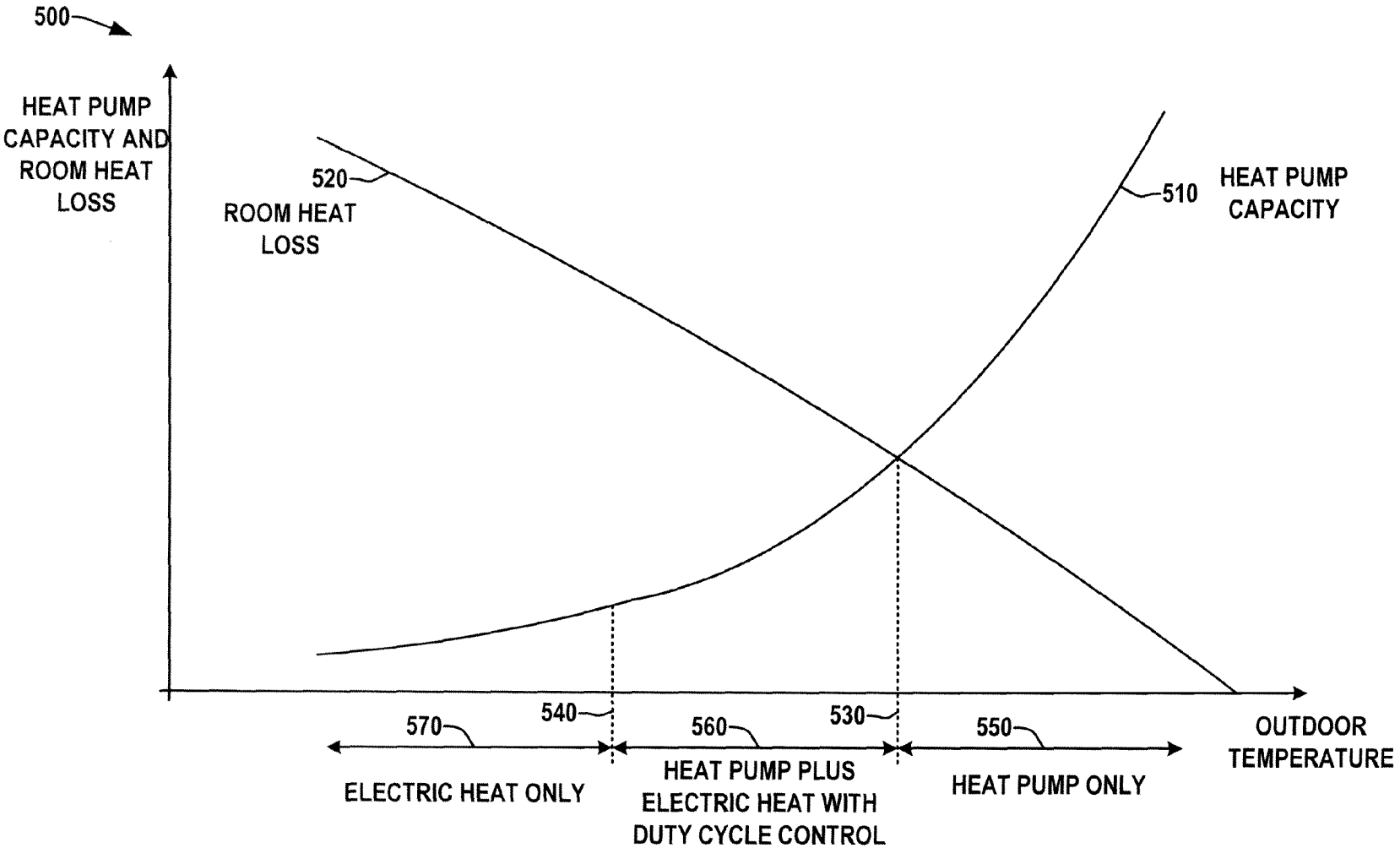
FIG. 5 is a graph illustrating exemplary curves showing heat pump capacity and room heat loss over a temperature range, including the balance point and the temperature at which the COP of the heat pump is at or near one, in the exemplary system of FIGS. 1-3.

FIG. 5 illustrates the thresholds and modes of the heat pump 120 during heating over an outdoor temperature range. The vertical axis of the graph shows heat energy, while the horizontal axis shows the outdoor temperature. Both the heat capacity of the heat pump 120 curve 510 and the heat loss of the room curve 520 are shown in relation to the outdoor temperature. The balance point 530, as described above, is the outdoor temperature at which the heat capacity 510 of the heat pump 120 is equal to the heat loss of the room 520, and therefore, the point at which the two curves 510 and 520 cross denotes the balance point 530 of the heat pump 120. When the outdoor temperature is above the balance point 530 and the system 100 is in heating mode, the electric heat module 200 is deactivated and the system 100 operates in a heat pump only mode 550. The coefficient of performance (COP), as described above, is the heat created divided by the energy required to create that heat. At the outdoor temperature 540 when the COP nears one, it is desirable to turn the heat pump 120 off to limit wear and tear, and operate the system 100 in the electric only mode 570. The outdoor temperature range between the balance point 530 and the temperature at which the COP of the heat pump nears one 540 is the crossover mode 560 in which both the heat pump 120 and the electric heat module 200 generate heat.

Several methods are available to determine the balance point 530 (upper threshold) and the temperature at which the COP of the heat pump nears one 540 (lower threshold) for the system 100. In certain embodiments, the lower threshold 540 is a predetermined temperature for the system 100, because outdoor temperature is a major factor when determining the COP of a heat pump 120. Other embodiments may measure the heat generated and the energy used to generate that heat to calculate the COP over the temperature range to determine the lower threshold temperature 540 dynamically to compensate for any inefficiencies specific to the system 100. In certain embodiments, the upper threshold temperature 530 is predetermined for the system 100, using a theoretical heat capacity curve 510 and a theoretical room heat loss curve 520. In certain embodiments, the upper threshold temperature 530 is calculated by measuring the amount of time needed for the room to cool from one temperature to another over a range of outdoor temperatures. This method will create a room heat loss curve 520 that more accurately represents the heat loss of the room the temperature of which is being controlled by the system 100. A more accurate room heat loss curve will provide a more accurate upper threshold temperature 530. The upper threshold temperature 530 may also be calculated by measuring the amount of time the room is below the desired level. When that time exceeds a predetermined time period, the unit controller 130 may assume that the heat pump 120 cannot keep up with the heat loss of the room, indicating that the outdoor temperature is below the balance point. The above examples are indicative of some, but not all, of the methods to determine the upper and lower thresholds temperatures 530 and 540.

As described above, the duty cycle is selectively controlled to provide the desired heat output. Several methods are available to determine the desired heat output of the heaters which in turn determines the desired duty cycle of the current passed from the external AC power source 110 to the PTC heater bank by the switch 220 during the crossover mode 560. Such methods determine how much supplemental heat is required to effectively heat the room. In certain embodiments, the required duty cycle is predetermined over temperature, for example using values in a lookup table. In certain implementations, the controller 130 checks the heater current and makes duty cycle adjustments to maintain the current level below a certain threshold, and the monitored current is influenced by the temperature of air being passed across the heater. As that temperature changes, the resistance of that heater changes and the current is affected, and thus these effects can be ascertained through current monitoring alone, or in combination with sensing of the indoor temperature via sensor 132 (FIG. 1). Thus, in certain embodiments, the percent duty cycle can be determined during startup or thereafter through monitoring of the current passing through the device over the range of temperatures of air being passed across the device, for instance. Using a closed loop proportionality constant which may be stored in a lookup table.

In other embodiments, the heat capacity 510 of the heat pump 120 is subtracted from the heat loss of the room 520 and that number is divided by the maximum heat available from the PTC heater banks 240 activated by the bank select module 246. In certain embodiments, the controller 130 is programmed with a lookup table and determines if the difference between the outdoor and indoor temperatures (e.g., $\Delta t$) is at a certain range. The controller 130 is preconfigured with a known value for the capacity of the unit and determines an assumed heat loss rate based on the sensed $\Delta t$. Based on the determined $\Delta t$ and the assumed heat loss, the controller 130 in certain embodiments determines whether it needs to apply supplemental heat from the PTC heater. The above methods are indicative of some, but not all, of the methods to determine the desired duty cycle of the current passed from the external AC power source 110 to the PTC heater bank by the switch 220.

Figure 6:
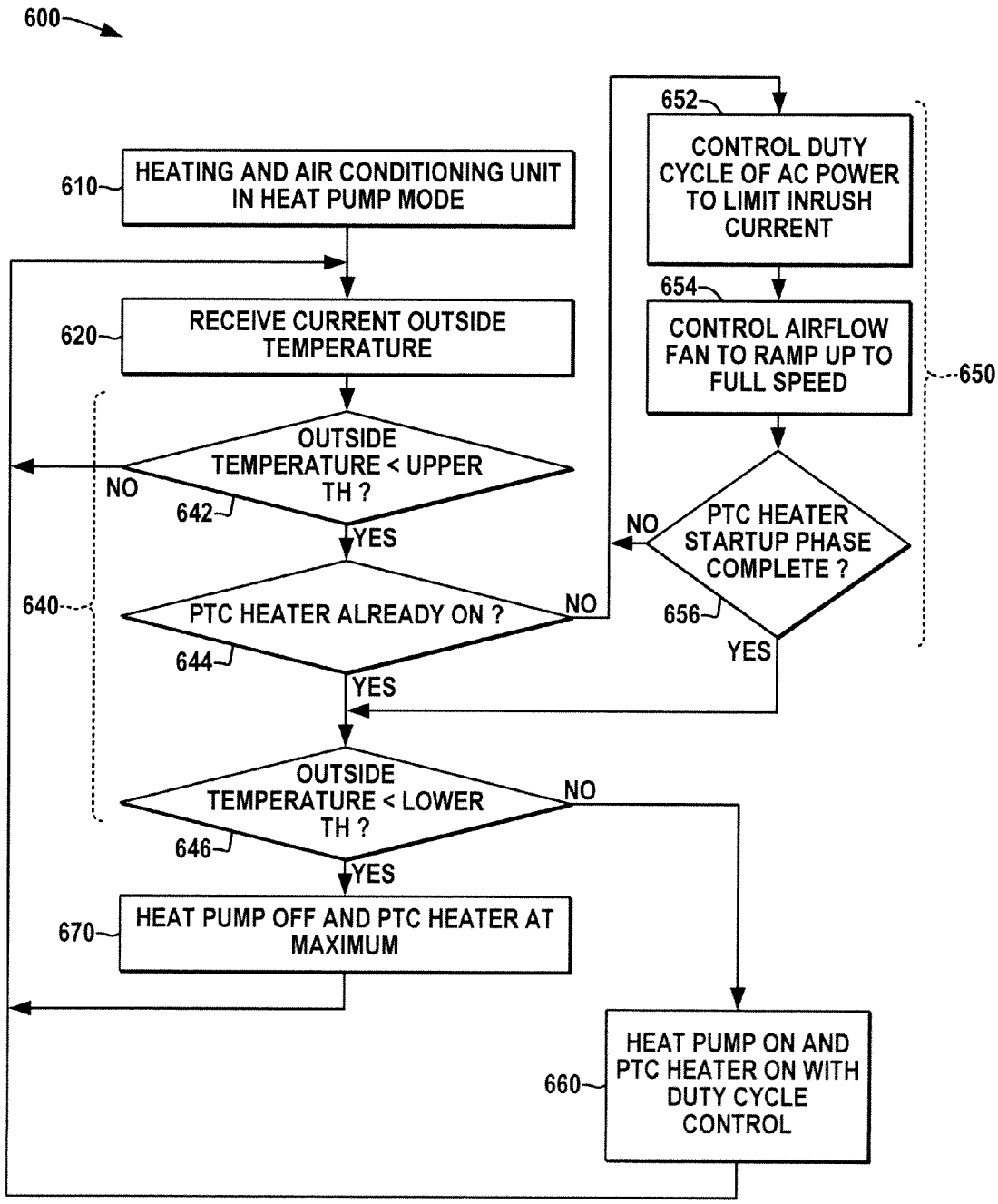
FIG. 6 is a flow chart illustrating an exemplary method of controlling the room air conditioning system of FIG. 1.

FIG. 6 is a flow diagram illustrating an exemplary method 600 of operating the air conditioning system 100 in heating mode requiring supplemental heat. While the method 600 is illustrated and described below in the form of a series of acts or events, it will be appreciated that the various methods of the disclosure are not limited by the illustrated ordering of such acts or events. In this regard, except as specifically provided hereinafter, some acts or events may occur in different order and/or concurrently with other acts or events apart from those illustrated and described herein in accordance with the disclosure. It is further noted that not all illustrated steps may be required to implement a process or method in accordance with the present disclosure, and one or more such acts may be combined. The illustrated methods and other methods of the disclosure may be implemented in hardware, software, or combinations thereof, such as in the exemplary system controller 130 or the heating module controller 230, in order to provide the supplemental heating aspects illustrated and described herein.

At 610 in FIG. 6, the system 100 is running in heat pump only mode 550. As described in relation to FIG. 1 above, the heat from the outside air 154 is absorbed by the refrigerant and dissipated to the inside air 152. At step 620, the system controller 130 receives a temperature value or indication of the temperature outdoors. At 640, the system controller 130 will compare the value received to an upper threshold at 642, the balance point 530 in this embodiment. If the outside temperature is at or above the balance point 530, then the system 100 will continue to operate in the heat pump only mode 550 and go back to step 620. If the outside temperature is below the balance point 530, then the system proceeds to step 644 where the heating module controller 230 checks if the PTC heaters 242 are already activated.

Figure 7:
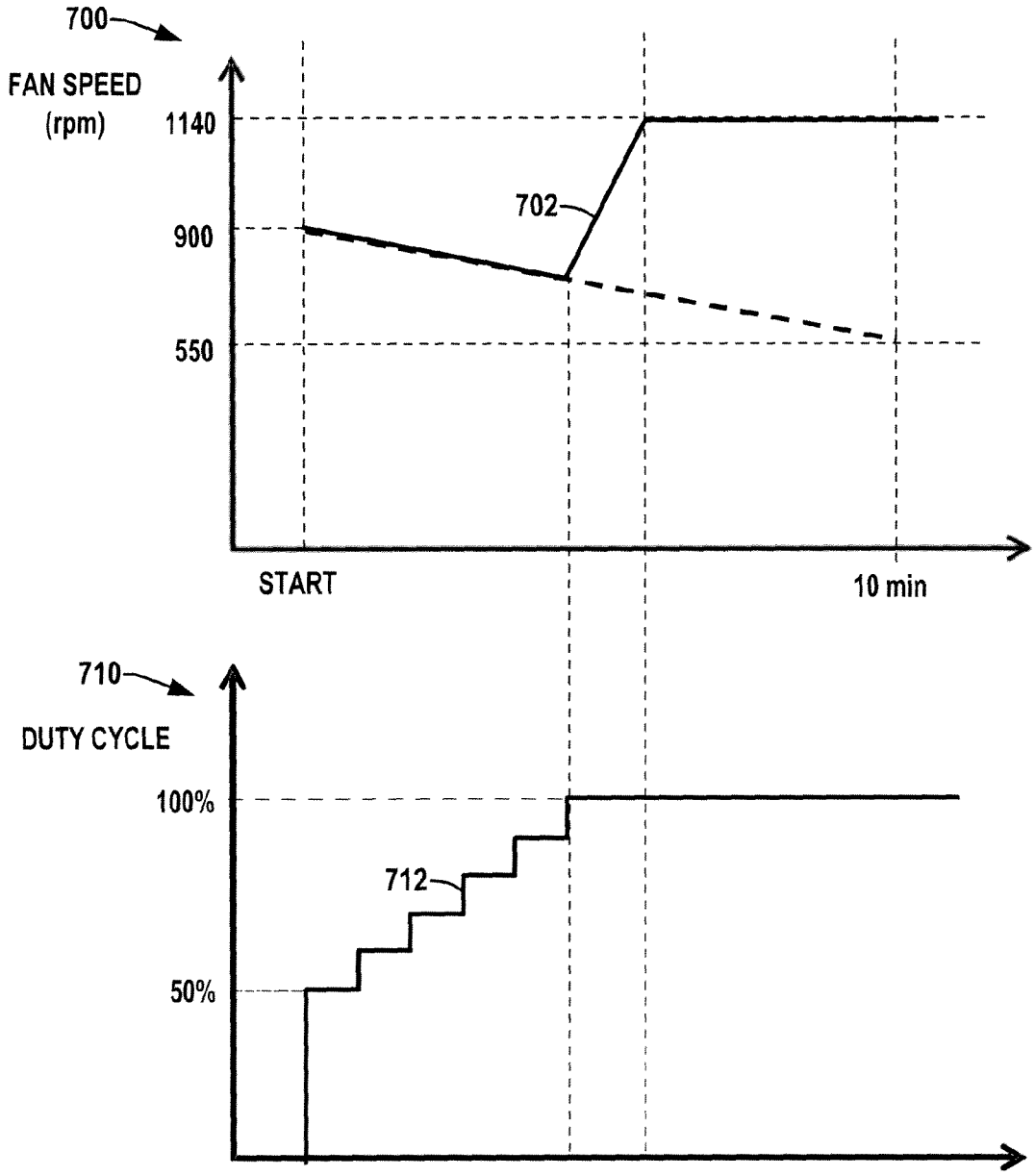
FIG. 7 is a composite graph illustrating exemplary operation with duty cycle control of the PTC heater and an embodiment of corresponding fan speed control during startup.

If the PTC heaters 242 are not activated, then the heating module controller 230 begins the startup phase of the PTC heaters 242 at 650. In the startup phase 650, the heating module controller 230 sends a switch gate drive signal 232 to the gate of the switch 220 to implement non-100% duty cycle control. The startup duty cycle in certain embodiments is preconfigured in a lookup table of the controller 130 lookup table, and control is thereafter modified, for example, as shown in FIG. 7 below. As described above in reference to FIG. 3, the switch 220 will pass or block all or a portion of the current supplied by the external AC power source 110 to the PTC heater bank 240 at 652, which effectively controls the duty cycle of that current. The inventors have appreciated that during the startup phase 650 of the PTC heaters 242, if the duty cycle of the current is not controlled, the inrush current to the PTC heaters 242 may degrade the output heat capacity of the PTC heaters 242 over time. By controlling the duty cycle of the current at 652 during the startup phase 650, the inrush current is lower and the PTC heater 242 experiences less degradation, improving the life span of the system 100.

During the startup phase 650, the heating module controller 230 will also control the speed of the fan 142 at 654 to reduce the amount of current drawn by the system 100. When the PTC heater 242 has reached a desired temperature at 656, the heating module controller 230 directs the heating module to exit the startup phase 650 and proceeds back to the temperature comparison at 640.

Continuing at 640, when the PTC heater 242 is fully activated, the heating module controller 230 compares the value of the outdoor temperature to the lower threshold 440 at 646. If the outdoor temperature is less than the lower threshold 540, then the heat pump 120 is turned off at 670 to limit wear and tear and the system 100 is in the electric only mode, where all of the heat is generated by the PTC heater banks 240. If the outdoor temperature is greater than the lower threshold 540 and below the upper threshold 530 (NO at 646), then the heat pump 120 remains on and the electric heating module 200 generates heat supplemental to the heat transferred by the heat pump 120 at 660 to raise the temperature of the room to the desired level. During the crossover phase 560 (FIG. 5), the heating module controller 230 and switch 220 control the duty cycle of the current supplied by the external AC power source 110 to the PTC heater bank 240. By controlling the duty cycle of the current at 660 during the crossover mode 560, the amount of heat generated by the electric heating module 200 is regulated. The difference between the heat loss of the room 520 and the heat capacity 510 of the heat pump indicates how much supplemental heat is needed to heat the room to the desired temperature. As described above, if significantly more heat is generated than what is needed, the room heats unnecessarily quickly and the amount of time the electric heating module 200 is activated is relatively short. The room cools down while the electric heating module 200 is not activated and the electric heat module 200 must be activated again to return the room to the desired temperature. This rapid heating process requires starting the electric heat module 200, requiring many startup phases 650. If the heat generated by the PTC heater banks 240 is near the difference between the heat pump capacity curve 510 and the room heat loss curve 420, the PTC heaters 242 are cycled less often, limiting the number of startup phases 650. Therefore, the duty cycle of the current to the PTC heater banks 240 is controlled to generate only what heat is needed to raise the temperature of the room to the desired level and maintain that temperature. By limiting the number of startup phases 650 associated with the crossover mode 560, the life span of the PTC heaters 242 may be increased.

Start up control operation in certain embodiments is illustrated in FIG. 7, which shows a graph 700 of fan speed 702 as a function of time and a graph 710 illustrating corresponding PTC percent duty cycle control 712 over time. In this embodiment, the PTC heater generates peak current, and the output is increased while controlling the peak current. In one implementation, when the unit is started, the fan will start up at 900 rpm when Hi speed operation is selected by the user, and at 800 rpm when at Low speed operation, with the PTC control started at 50% duty cycle. In the illustrated case of FIG. 7, the fan speed is gradually reduced at a rate corresponding to a drop from 900 to 550 rpm at 10 min, but the control will monitor the current value and increase the duty cycle 712 from 50% to 100%, in one case, as a stepped increase, although not a strict requirement of the present disclosure. In the embodiment illustrated in FIG. 7, once the percent duty cycle 712 has been thus increased to 100%, the fan speed 702 is increased to the set fan speed (e.g., 1140 is one embodiment).

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

The following is claimed:

1. An electric heating module for a room air conditioning unit comprising:

an electric heater bank having at least one electric heating element;

a fan operative to generate airflow along the electric heater bank;

a heating module controller operative to produce a switch control signal; and a switch operatively coupled with an AC power source and with the electric heater bank, the switch operative in a first state to selectively allow current to flow between the AC power source and the electric heater bank and in a second state to prevent current flow between the AC power source and the electric heater bank, the switch state being determined based at least in part on the switch control signal.

2. The electric heating module of claim 1, wherein the electric heating element is a positive temperature coefficient (PTC) heating element.

3. The electric heating module of claim 2, wherein the switch selectively controls a duty cycle of AC power supplied to the electric heater bank from the AC power source during a startup phase of the electric heating module.

4. The electric heating module of claim 3, wherein heating module controller provides a fan speed control signal to the fan, and wherein the heating module controller is operative to gradually ramp up a speed of the fan to an operational speed during the startup phase of the electric heating module.

5. The electric heating module of claim 3, wherein the switch selectively controls the duty cycle of AC power supplied to the electric heater bank by controlling an on time and an off time in each of a plurality cycles of the AC power source during the startup phase of the electric heating module, wherein the switch is in the first state to allow current flow to the electric heater bank during the on time, and wherein the switch is in the second state to prevent current flow to the electric heater bank during the off time.

6. The electric heating module of claim 1, further comprising:

a current limit module operative to produce a current limit indication which indicates the maximum current that the air conditioning unit may draw; and a bank select control operative to selectively activate one or more electric heater banks based at least partially on the current limit indication.

7. The electric heating module of claim 6, wherein the switch is a triode for alternating currents (TRIAC) and the heating module controller includes a solid state relay.

8. The electric heating module of claim 1, wherein the switch is a triode for alternating currents (TRIAC) and the heating module controller includes a solid state relay.

9. The electric heating module of claim 1, wherein the at least one electric heating element is a resistive electrical component operative to generate heat when electrical current is conducted through the at least one electric heating element.

10. A method for operating a heating and air conditioning system, the method comprising:

receiving a current outside temperature value or signal indicative of an outside area temperature;

operating an air conditioning portion of the system as a heat pump to heat an inside area with an electric heating module of the system off in a first mode when the current outside temperature value or signal is above an upper threshold;

concurrently operating the air conditioning portion of the system as a heat pump to heat the inside area and operating the electric heating module of the system by controlling a duty cycle of AC power provided to at least one electric heater bank of the electric heating module to supplement the heat generated by the heat pump in a second mode when the current outside temperature value or signal is less than or equal to the upper threshold and greater than a lower threshold; and operating the electric heating module of the system to heat the inside area with the heat pump off in a third mode when the current outside temperature value or signal is less than or equal to the lower threshold.

11. The method of claim 10, further comprising controlling a duty cycle of the AC powered electric heater during a startup phase of the electric heater.

12. The method of claim 11, further comprising gradually increasing a speed of a fan to generate airflow along the electric heater bank during the startup phase of the electric heater.

13. The method of claim 10, wherein the electric heater comprises a positive temperature coefficient (PTC) heating element.

14. The method of claim 10, wherein the switch selectively controls the duty cycle of AC power supplied to the electric heater bank by controlling an on time and an off time in each of a plurality cycles of the AC power source during the startup phase of the electric heating module, wherein the switch is in the first state to allow current flow to the electric heater bank during the on time, and wherein the switch is in the second state to prevent current flow to the electric heater bank during the off time.

15. A room air conditioning system for heating and cooling of a room, comprising:

a heat pump system;

an electric heater bank comprising at least one electric heating element;

an indoor temperature sensor for sensing the temperature the room;

an outdoor temperature sensor for sensing the outdoor temperature;

a controller responsive to the indoor and outdoor temperature sensors and operative to control the operation of the heat pump as a function of the sensed indoor and outdoor temperatures and operative to control the duty cycle of the heater bank as a function of the sensed room temperature.

16. The room air conditioning system of claim 15, wherein the controller comprises an electronic switching device for coupling the heater bank to an external alternating current power supply and wherein the controller controls the duty cycle by controlling the firing angle of the electronic switching device to phase control the power signal applied to the heater bank.

17. The room air conditioning system of claim 15, wherein the controller is operative to control the duty cycle of the heater bank to limit inrush current during a startup phase of the electric heater bank.

18. The room air conditioning system of claim 17, further comprising a fan for circulating air over the heater bank, the controller being operative to vary the speed of the fan as a function of to limit the current drawn by the heater bank during the startup phase.

19. The room air conditioning system of claim 15, wherein the at least one electric heating element is a resistive electrical component operative to generate heat when electrical current is conducted through the at least one electric heating element.

20. The room air conditioning system of claim 15, wherein the controller selectively controls the duty cycle of AC power supplied to the electric heater bank by controlling an on time and an off time in each of a plurality cycles of the AC power source during the startup phase of the electric heating module, wherein the switch is in the first state to allow current flow to the electric heater bank during the on time, and wherein the switch is in the second state to prevent current flow to the electric heater bank during the off time.

* * * * *

UNITED STATES PATENT AND TRADEMARK OFFICE

CERTIFICATE OF CORRECTION

PATENT NO. : 8,309,894 B2
APPLICATION NO. : 12/704816
DATED : November 13, 2012
INVENTOR(S) : Tom C. Zimmer et al.

It is certified that error appears in the above-identified patent and that said Letters Patent is hereby corrected as shown below:

In Column 2, Line 47, delete “bank:” and insert -- bank; --, therefor.

Signed and Sealed this
Ninth Day of April, 2013

Teresa Stanek Rea
*Acting Director of the United States Patent and Trademark Office*